US008418296B1

(12) United States Patent
Hanlon et al.

(10) Patent No.: US 8,418,296 B1
(45) Date of Patent: Apr. 16, 2013

(54) THERAPEUTIC MATTRESS

(76) Inventors: James Ben Hanlon, Cisco, TX (US); Steven David Robinson, Austin, TX (US)

( * ) Notice: Subject to any disclaimer, the term of this patent is extended or adjusted under 35 U.S.C. 154(b) by 0 days.

(21) Appl. No.: 13/298,203

(22) Filed: Nov. 16, 2011

Related U.S. Application Data

(60) Provisional application No. 61/414,403, filed on Nov. 16, 2010.

(51) Int. Cl.
*A47C 27/08* (2006.01)

(52) U.S. Cl.
USPC ..... 5/713; 5/714; 5/724

(58) Field of Classification Search ..... 5/706, 708, 5/710–714, 724, 726, 731, 736, 652.1, 652.2, 5/655.3, 941
See application file for complete search history.

(56) References Cited

U.S. PATENT DOCUMENTS

| | | | | |
|---|---|---|---|---|
| 813,731 | A | 2/1906 | Murmans | |
| 3,372,407 | A | 2/1966 | Weber, III | |
| 3,297,023 | A * | 1/1967 | Foley | 601/148 |
| 4,175,297 | A * | 11/1979 | Robbins et al. | 5/284 |
| 4,939,804 | A | 7/1990 | Grant | |
| 5,030,495 | A * | 7/1991 | Neu | 428/76 |
| 5,483,711 | A * | 1/1996 | Hargest et al. | 5/725 |
| 5,652,987 | A * | 8/1997 | Fujita | 5/726 |
| 5,887,304 | A * | 3/1999 | von der Heyde | 5/726 |
| 6,047,424 | A * | 4/2000 | Osborne et al. | 5/713 |
| 7,396,796 | B2 * | 7/2008 | Kato et al. | 502/152 |
| 7,650,658 | B1 | 1/2010 | McKay et al. | |
| 2003/0033790 | A1 | 2/2003 | Hague | |
| 2006/0010607 | A1 * | 1/2006 | Schneider | 5/713 |
| 2007/0136952 | A1 | 6/2007 | Sargent | |
| 2008/0178392 | A1 * | 7/2008 | Chu | 5/713 |
| 2012/0079662 | A1 * | 4/2012 | Dzioba et al. | 5/713 |

* cited by examiner

*Primary Examiner* — William Kelleher
*Assistant Examiner* — Richard G Davis
(74) *Attorney, Agent, or Firm* — QuickPatents; Kevin Prince

(57) ABSTRACT

A mattress system for a patient includes an inflatable mattress having at least one inflatable bladder, each having at least one inflation port and a plurality of selectively sealable deflation pinholes. When fully deflated the inflatable mattress may be rolled up into a compact storage configuration. An air pump is in fluid communication with the inflation port of each inflatable bladder and is adapted to pressurize the bladder with air treated with an ozone generator, sanitizer, or the like. Such an air pump is preferably controlled by a controller circuit that may be included to inflate any of the inflatable bladders and activate or deactivate the air treatment apparatus, based on, for example, a pre-programmed schedule or regiment as directed by a medical professional. Auxiliary attachments, such as an appendage sleeve, a blanket, or the like, may also be inflated with the air pump.

17 Claims, 9 Drawing Sheets

THERAPEUTIC MATTRESS

CROSS-REFERENCE TO RELATED APPLICATIONS

This application claims the benefit of U.S. Provisional Patent Application 61/414,403, filed on Nov. 16, 2010, and incorporated herein by reference.

STATEMENT REGARDING FEDERALLY SPONSORED RESEARCH AND DEVELOPMENT

Not Applicable.

FIELD OF THE INVENTION

This invention relates to mattresses, and more particularly to an air purification and treatment mattress.

DISCUSSION OF RELATED ART

Patients suffering from ailments such as pressure ulcers, wounds, and other ailments can benefit from purified and treated air towards the affected area or areas. Ozone, UV, and/or ionized air help to destroy bacteria and other volatile organic compounds (VOC).

In US Patent Application 2007/0136952 to Sargent on Jun. 21, 2007, a sleep system with purified air utilizing a latex foam mattress is taught. Such a product, while perhaps able to deliver filtered air to a patient, does not teach the delivery of Ozone, UV and/or ionized air to a patient at specific areas of the patient needing such treated air, such as near areas of the patient affected by ulcers or bed sores, for example. Further, such a device does not allow for alternating inflatable bladders for alternately relieving pressure on areas of the patient.

Therefore, there is a need for a mattress system that provides a custom administration of treated air to patients lying on an inflatable mattress. Such a needed device would provide for alternating inflatable bladders that alternately relieve pressure on specific areas of the patient that are normally in contact with the mattress. Further, such a device would be programmable so that a specific regiment of treated air could be easily delivered to the patient throughout the day. The present invention accomplishes these objectives.

SUMMARY OF THE INVENTION

The present device is a mattress system for a patient. The mattress system may be incorporated into a bed mattress, or may itself be supported on a bed or other mattress. An inflatable mattress of the mattress system has at least one inflatable bladder, each of which has at least one inflation port and a plurality of deflation pinholes on a top surface thereof. In one embodiment, the top surface of each inflatable bladder includes a plurality of selectively sealable deflation ports that each may be opened and covered with a pinhole diffuser, such that each deflation port may be selectively sealed or partially opened with the pinhole diffuser. Each deflation port preferably includes a selectively sealable flap that may be opened to reveal one of the pinhole diffusers, or closed to seal the deflation port. Preferably the inflatable mattress is flexible such that when fully deflated the inflatable mattress may be rolled up and stored in a compact configuration. Such an air mattress, when inflated, assumes a flat configuration.

An air pump is in fluid communication with the inflation port of each inflatable bladder and is adapted to pressurize the bladder with air. Such an air pump is preferably controlled by a controller circuit that may be included to inflate any of the inflatable bladders and activate or deactivate the air treatment apparatus, based on, for example, a pre-programmed schedule or regiment as directed by a medical professional.

In one embodiment, the air mattress includes a plurality of inflatable bladders, such as two. The air pump and controller circuit is adapted to inflate each inflatable bladder in turn, such that upon inflation of the first of the inflatable bladders the air pump switches to inflate a second of the inflatable bladders, and the first of the inflatable bladders thereafter deflates as air escapes through the plurality of deflation pinholes therein.

An air treatment apparatus is in fluid communication with the air pump and adapted for treating the air pumped into each inflatable bladder. Such an air treatment apparatus may be, for example, an ozone generator for introducing ozone into the air that is pumped into each inflation bladder, an ultraviolet light sanitizer for introducing sanitized air into the air that is pumped into each inflation bladder, or the like.

In one embodiment, the air pump further includes an auxiliary output port adapted for pressurizing one of a plurality of auxiliary attachments, such as an appendage sleeve, a blanket, or the like, with the treated air, each auxiliary attachment including an inlet port and a plurality of the deflation ports or the deflation pinholes.

The present invention is a mattress system that provides a custom administration of treated air to patients lying on an inflatable mattress. The present device further provides for alternating inflatable bladders that alternately relieve pressure on specific areas of the patient that are normally in contact with the mattress. Such a device is also programmable so that a specific regiment of treated air can be easily delivered to the patient throughout the day. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
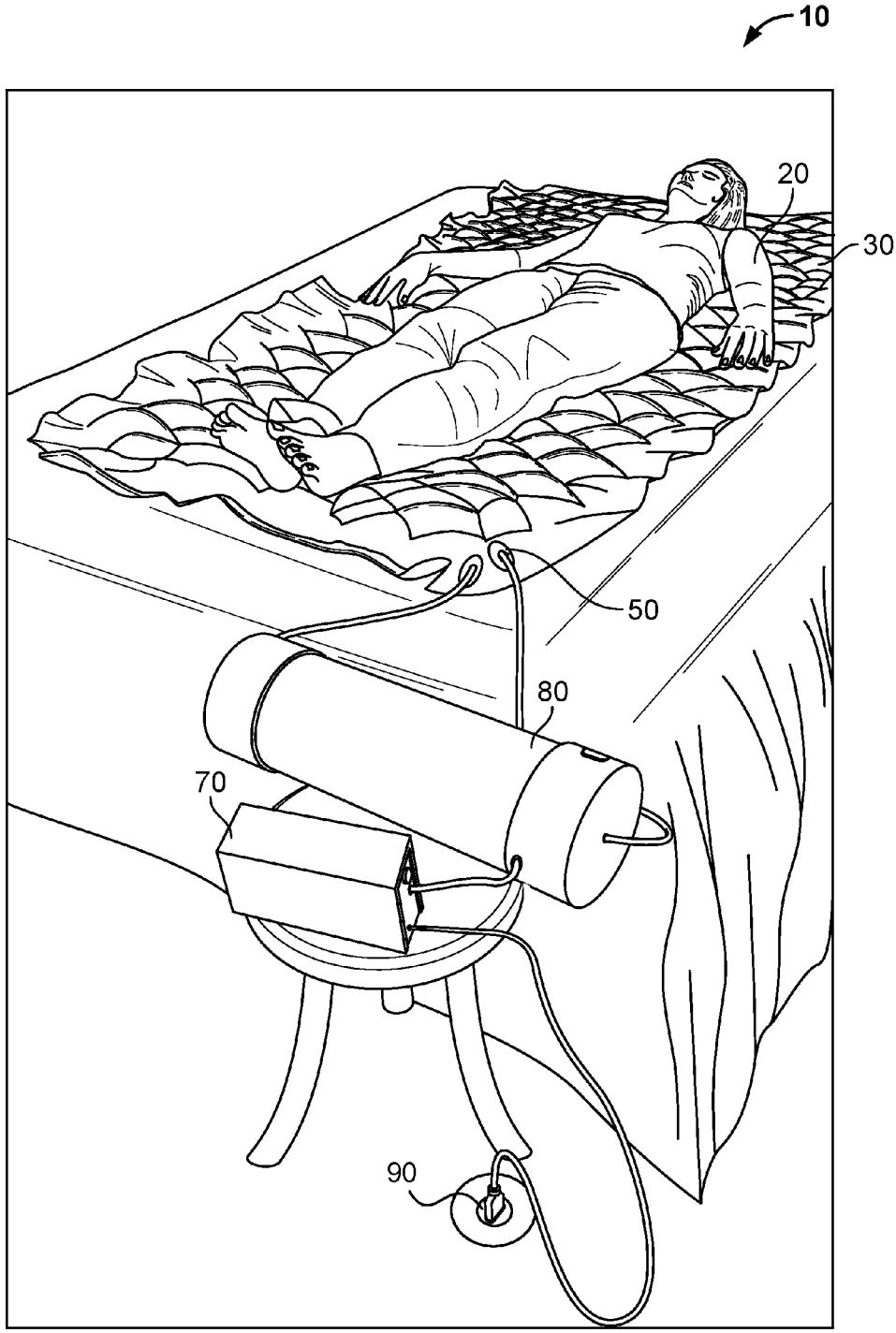
FIG. 1 is a perspective view of the invention, illustrating a patient lying on an inflatable mattress thereof.
Figure 2:
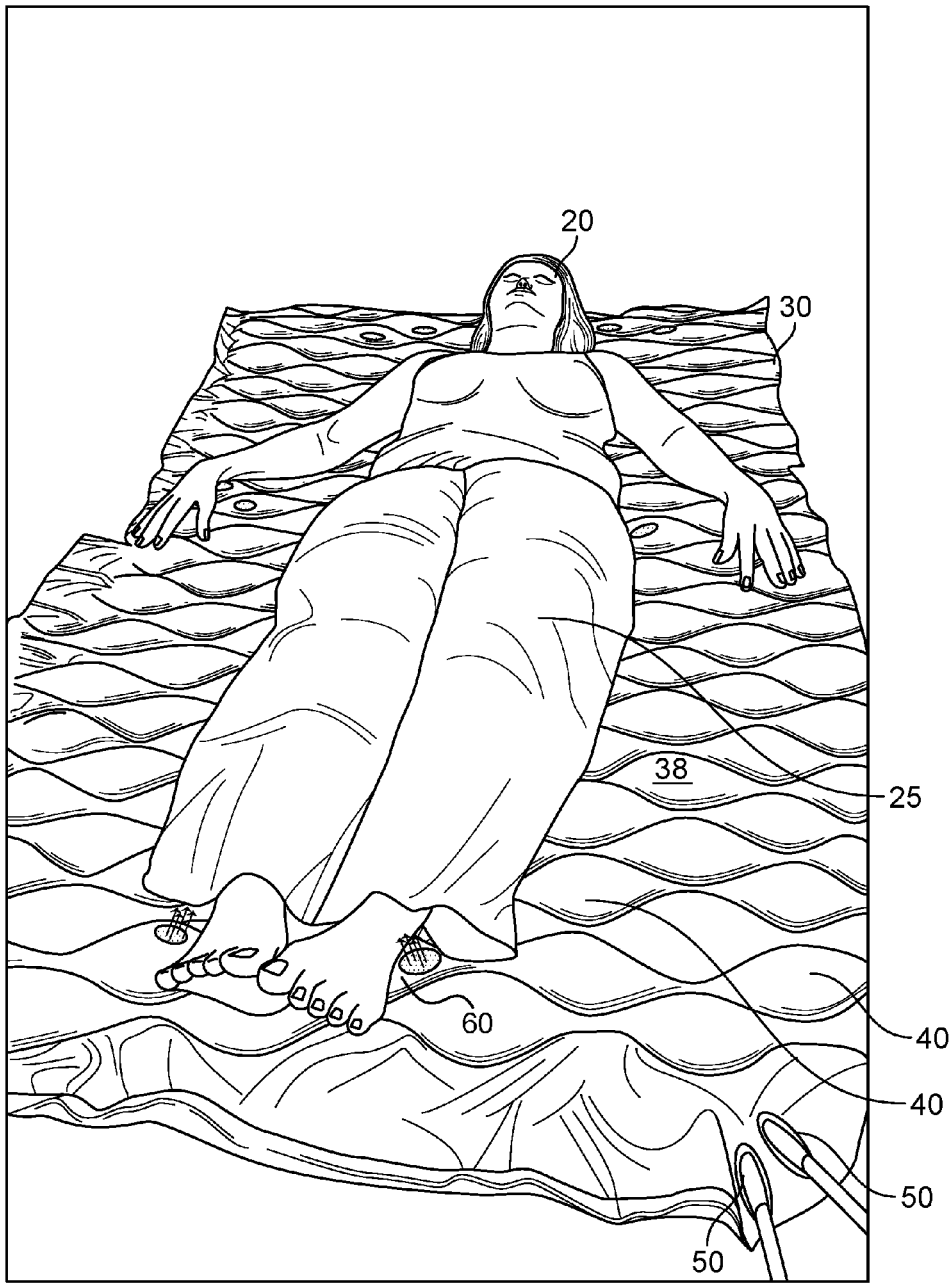
FIG. 2 is an alternate perspective view of one embodiment of the inflatable mattress.
Figure 4:
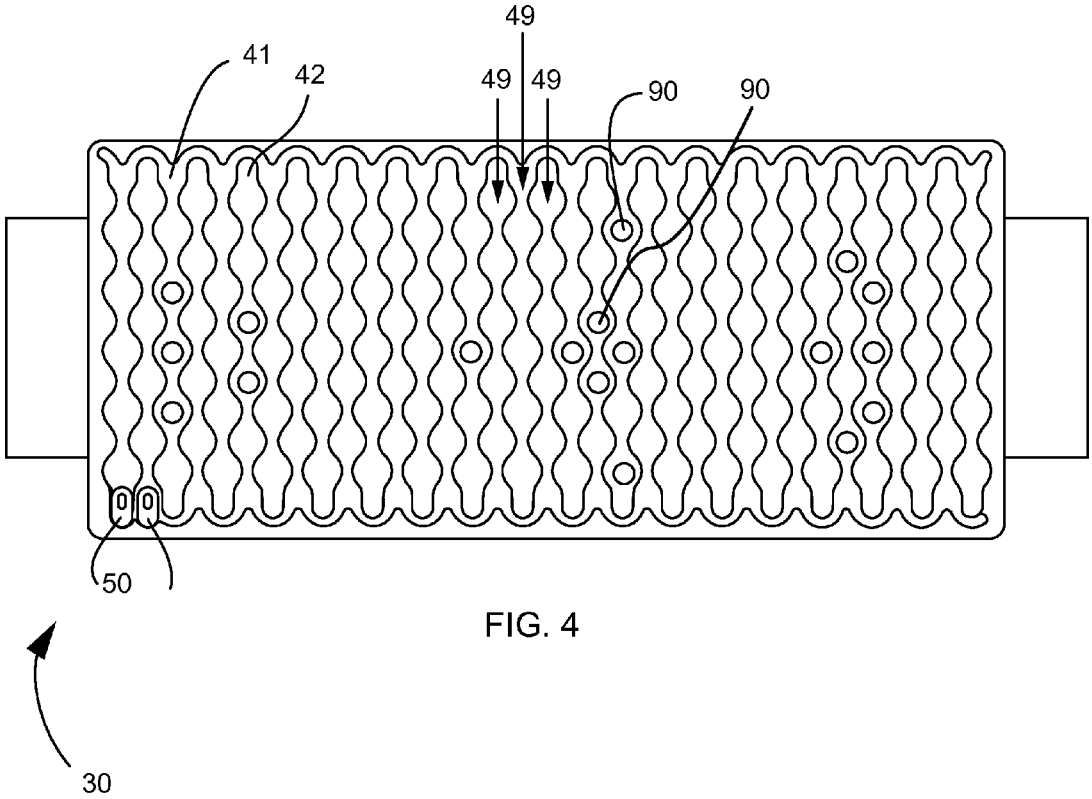
FIG. 4 is a top plan view of one embodiment of the inflatable mattress.

FIGS. 1 and 4 illustrate a mattress system 10 for a patient 20. The mattress system 10 may be incorporated into a bed mattress (not shown), or may itself be supported on a bed frame, another mattress, or other generally flat support.

An inflatable mattress 30 has at least one inflatable bladder 40, each of which has at least one inflation port 50 and a plurality of deflation pinholes 60 on a top surface 38 thereof. Preferably the inflatable mattress 30 includes a plurality of the inflatable bladders 40, such as a first inflatable bladder 41 and a second inflatable bladder 42. Preferably each inflatable bladder 40 includes a plurality of channels 49, the channels of one inflatable bladder 41 interspersed with the channels 49 of at least one of the other inflatable bladders 42, so that generally even support of the patient 25 is maintained when the bladders 41,42 are alternately inflated and deflated.

Figure 3:
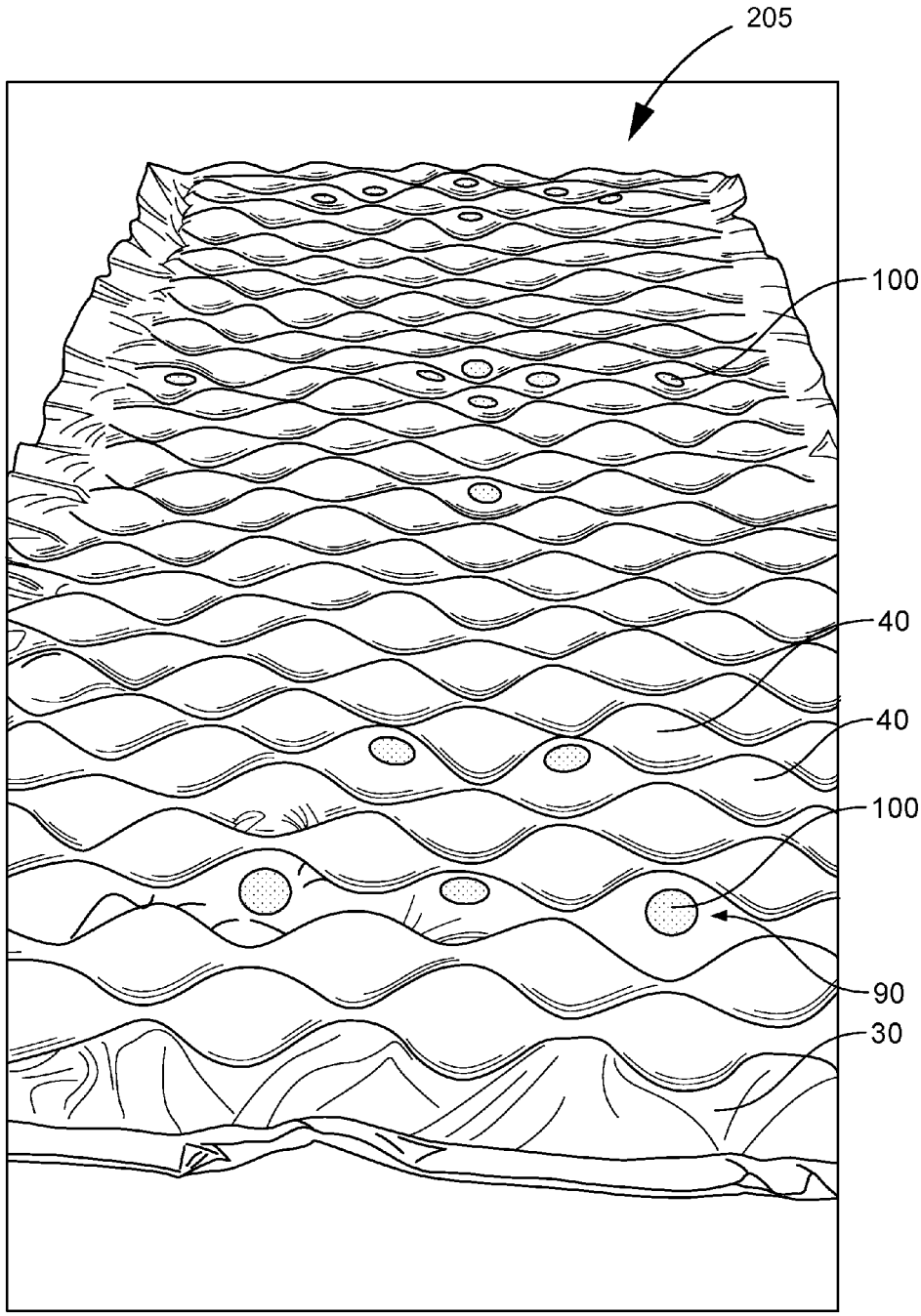
FIG. 3 is a perspective view of FIG. 2, shown with the patient omitted for clarity of illustration.
Figure 11:
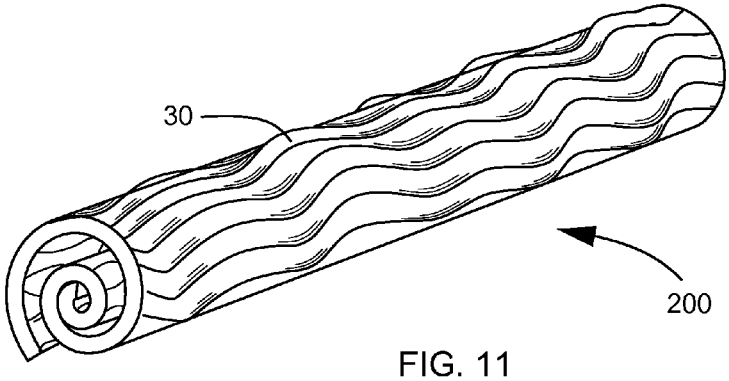
FIG. 11 is a perspective view of the mattress in a rolled-up configuration.

In one embodiment, the top surface 38 of each inflatable bladder 40 includes a plurality of selectively sealable deflation ports 90 that each may be opened and covered with a pinhole diffuser 100, such that each deflation port 90 may be selectively sealed or partially opened with the pinhole diffuser 100. Each deflation port 90 preferably includes a selectively sealable flap 110 that may be opened to reveal one of the pinhole diffusers 100, or closed to seal the deflation port 90. Preferably the inflatable mattress 30 is flexible such that when fully deflated the inflatable mattress 30 may be rolled up and stored in a compact configuration 200 (FIG. 11). Such an air mattress 30, when inflated, assumes a flat configuration 205 (FIG. 3).

An air pump 70 (FIGS. 5, 7 and 8) or blower is in fluid communication with the inflation port 50 of each inflatable bladder 40, is adapted to pressurize the bladder 40 with air, and is powered by an electrical outlet, batteries, or other suitable power source. Such an air pump 70 is preferably controlled by a controller circuit 190 that may be included to inflate any of the inflatable bladders 40 and activate or deactivate an air treatment apparatus 80, based on, for example, a pre-programmed schedule or regiment as directed by a medical professional. Such a controller circuit 190 may having a programming means to accommodate varied schedules, regiments, or prescriptions, and is adapted to control the speed of the air pump 70, the duration of the inflation of each of the inflatable bladders 40 by the air pump 70, the on/off status of the air treatment apparatus 80, the intensity level of the air treatment apparatus 80 such as the UV light sanitizer 130 intensity or voltage of the ozone generator 120, or the like. Such a controller circuit 190 is also preferably adapted to control the type of air treatment provided by the air treatment apparatus 80, such as controlling if the air is treated with ultraviolet light, ozone, or both, for example. A manual actuator knob 300 (FIG. 8) may be included for manually programming, selecting or overriding at least one operating parameter of the controller circuit 90.

Figure 5:
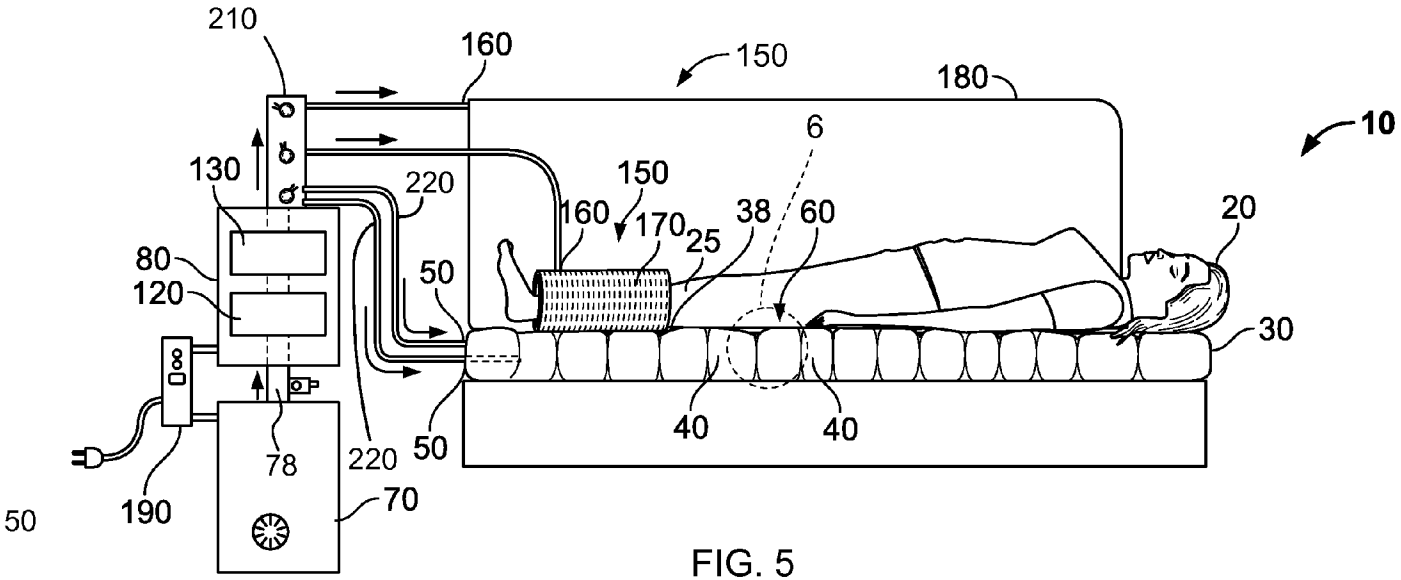
FIG. 5 is a side elevational diagram of the invention, illustrated with a plurality of auxiliary attachments.
Figure 6:
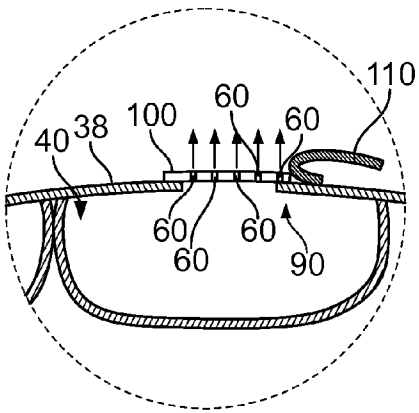
FIG. 6 is a cross-sectional diagram of one channel of the inflatable mattress, taken generally along lines 6-6 of FIG. 5.
Figure 8:
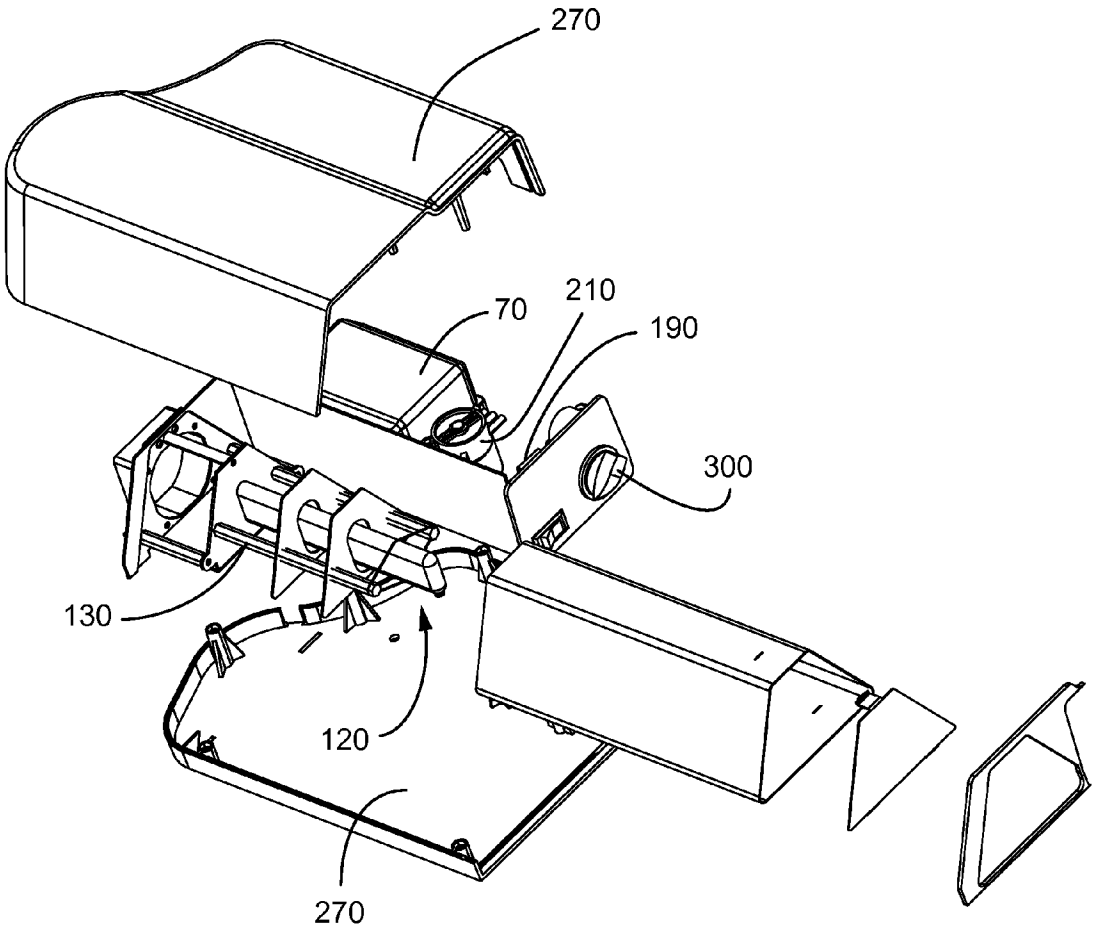
FIG. 8 is an exploded view of FIG. 7.

In one embodiment, the air mattress 30 includes two of the inflatable bladders 40. The air pump 70 and controller circuit 190 are adapted to inflate each inflatable bladder 41,42 in turn, such that upon inflation of the first of the inflatable bladders 41 the air pump 70 switches to inflate the second of the inflatable bladders 42, and the first of the inflatable bladders 41 thereafter deflates as air escapes through the plurality of deflation pinholes 60 therein. It may take, for example, two minutes to fully inflate one of the air bladders 40, and another two minutes for the air bladder 40 to substantially deflate once the air pump 70 switches to another of the inflatable bladders 40. The air pump 70 may include an electrically-actuable valve mechanism 210 to facilitate the switching of the air pump 70 from inflating one inflatable bladder 40 to another (FIGS. 5 and 8). Such a valve mechanism 210 is adapted to divert the air flowing from an output of the air pump 78 to a plurality of channel outputs 220, each of which is in fluid communication with one of the inflatable bladders 40.

The air treatment apparatus 80 is in fluid communication with the air pump 70 and adapted for treating the air pumped into each inflatable bladder 40. Such an air treatment apparatus 80 may be, for example, an ozone generator 120 (FIGS. 5 and 8) for introducing ozone into the air that is pumped into each inflation bladder 40, powered by an electrical outlet 19 or other suitable power source. Alternately, the air treatment apparatus 80 may be a photo catalytic oxidization device (not shown), and may also include an ultraviolet light sanitizer 130 for introducing sanitized air into the air that is pumped into each inflation bladder 40. Other air treatment apparatus 80 may be included, such as air scenting devices, filters, cleaners, or the like (not shown).

In one embodiment, the air pump 70 further includes an auxiliary output port 140 adapted for pressurizing one of a plurality of auxiliary attachments 150 (FIG. 5) with the treated air, each auxiliary attachment including an inlet port 160 and a plurality of the deflation ports 90 or the deflation pinholes 60. Such an auxiliary attachment 150 may be, for example, a sleeve 170 adapted for securing around an appendage 25 of the patient 20 and directing the treated air inwardly theretowards. Another of the auxiliary attachments 150 may be a blanket 180 adapted to direct the treated air downwardly about the patient 20, for example.

Figure 10:
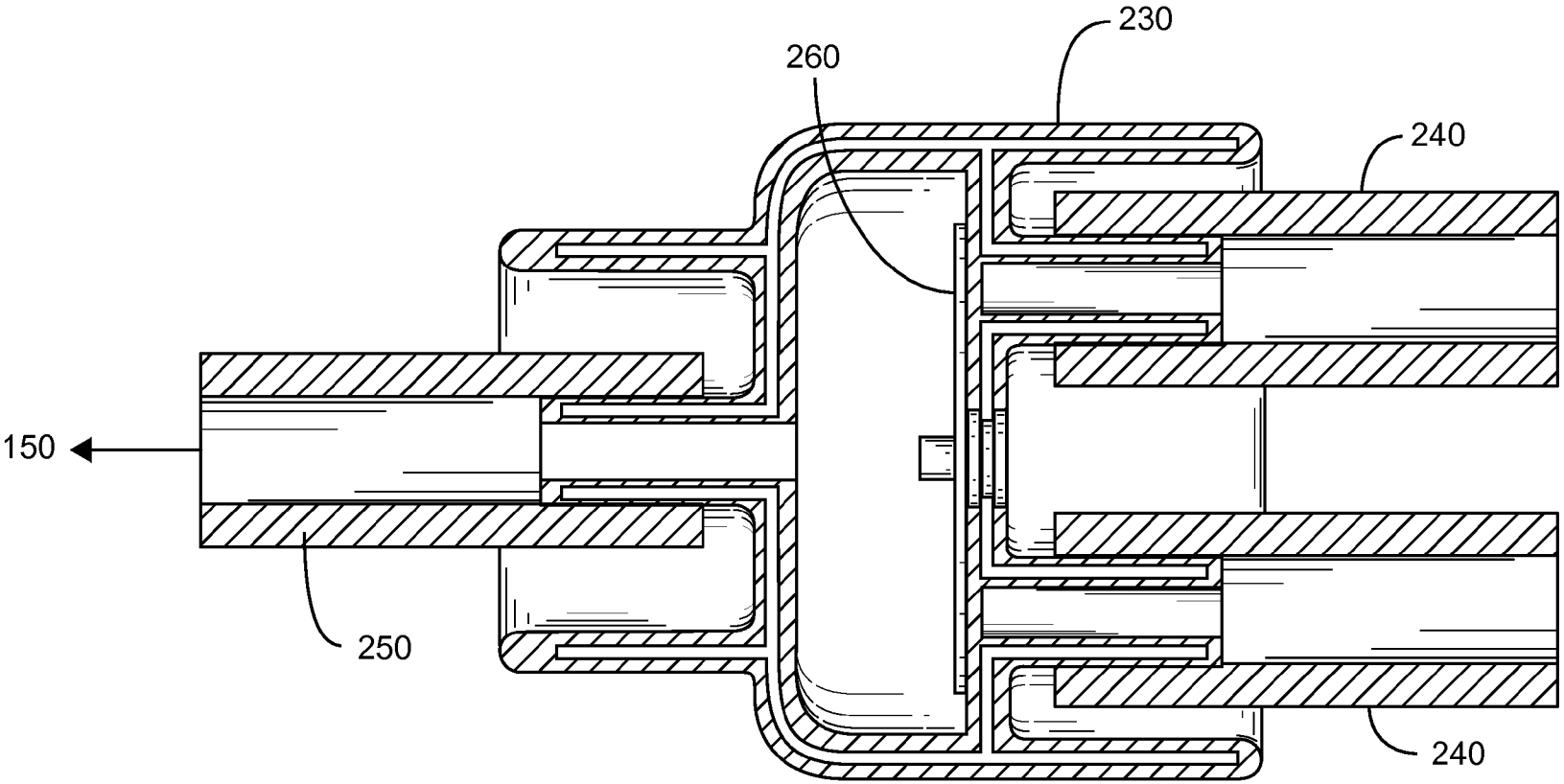
FIG. 10 is a cross-sectional view of an accessory adapter of the invention.

When such an auxiliary attachment 150 is desired to be used exclusively, an accessory adapter 230 (FIG. 10) may be included for directing air from either of the channel outputs 220 to the auxiliary attachment 150. The accessory adapter 230 includes a plurality of air inputs 240, each of which is in fluid communication with one of the channel outputs 220 of the air pump 70 when in use. Each of the air inputs 240 is also in fluid communication with a common output 250 via a check valve 260, such as a silicon rubber disk biased to cover each air input 240. As such, the common output 250 may be fluidly connected to the auxiliary attachment 150 for inflating thereof regardless of which channel output 220 is supplying air.

Figure 7:
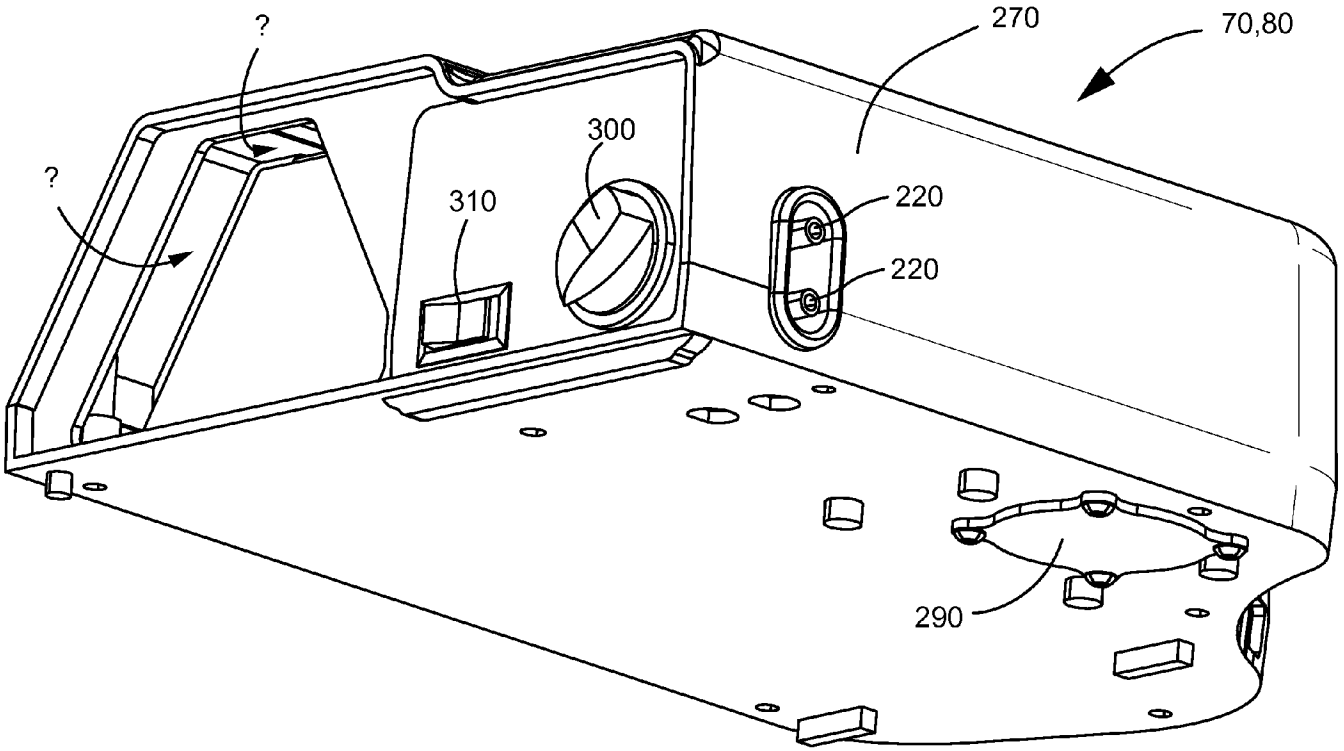
FIG. 7 is a bottom perspective view of a housing for containing an air pump and an air treatment apparatus of the invention.
Figure 9:
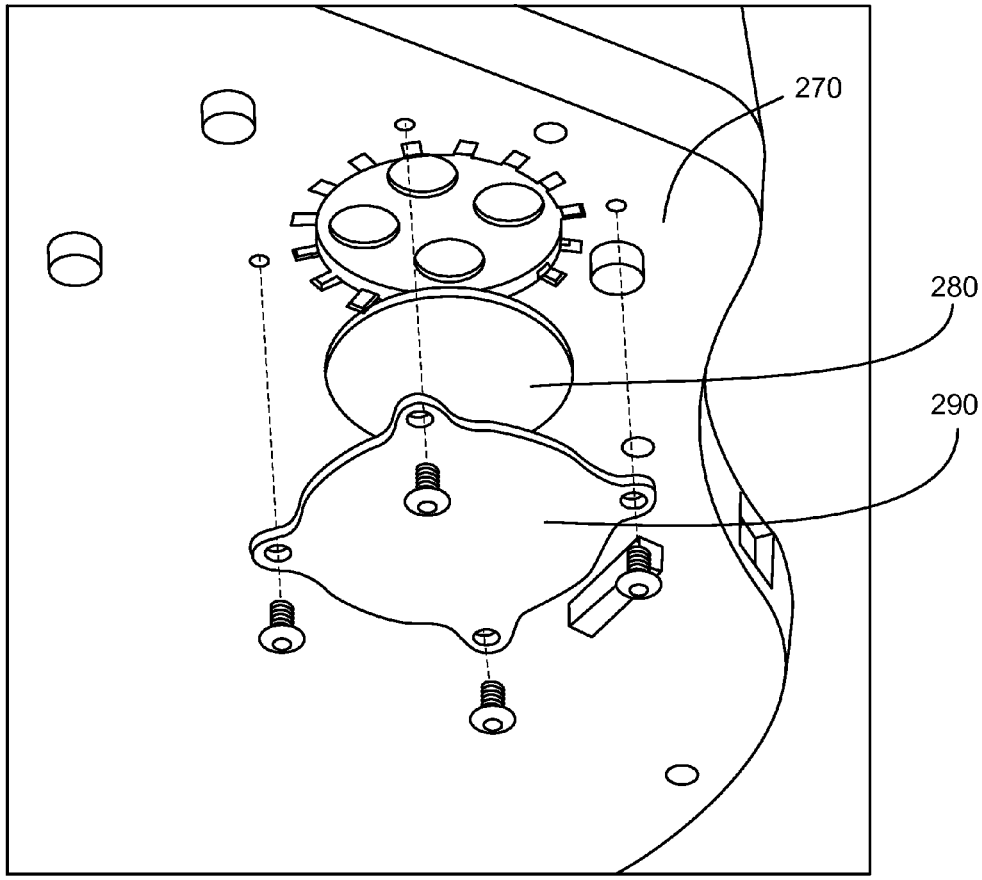
FIG. 9 is a partial exploded view of FIG. 7.

Preferably the air pump 70, air treatment apparatus 80, controller circuit 190, and valve mechanism 210 are all contained together in a rigid housing 270, such as a plastic or metal housing (FIGS. 7-9). A filter element 280 of the air pump 270 is preferably accessible through the rigid housing 270 at a removable filter cover 290 thereof (FIG. 9).

While a particular form of the invention has been illustrated and described, it will be apparent that various modifications can be made without departing from the spirit and scope of the invention. For example, while the illustrations show the inflatable mattress 30 having two separate, alternating inflatable bladders 40, the inflatable mattress 30 may include more than two bladders 40, and the bladders 40 may be segregated into non-alternating zones, for example. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A mattress system for a patient, comprising:

an inflatable mattress having at least one inflatable bladder having an inflation port and a plurality of deflation pinholes on a top surface thereof;

an air pump in fluid communication with the inflation port of the at least one inflatable bladder and adapted to pressurize the at least one inflatable bladder with air; and an air treatment apparatus in fluid communication with the air pump and adapted for treating the air pumped into the at least one inflatable bladder;

the top surface of the at least one inflatable bladder including a plurality of selectively sealable deflation ports that each may be opened and covered with a pinhole diffuser, such that each deflation port may be selectively sealed or partially opened with the pinhole diffuser.

2. The mattress system of claim 1 wherein the inflatable mattress includes a plurality of the inflatable bladders, and wherein the air pump is adapted to inflate each inflatable bladder in turn, such that upon inflation of a first of the inflatable bladders, the air pump switches to inflate a second of the at least one inflatable bladders, the first of the inflatable bladders thereafter deflating as air escapes through the plurality of deflation pinholes therein.

3. The mattress system of claim 2 wherein each inflatable bladder includes a plurality of channels, each channel of one bladder interspersed with the channels of at least one of the other bladders, whereby generally even support of the patient is maintained when the bladders are alternately inflated and deflated.

4. The mattress system of claim 1 wherein each deflation port includes a selectively sealable flap that may be opened to reveal one of the pinhole diffusers, or closed to seal the deflation port.

5. The mattress system of claim 1 wherein the air treatment apparatus includes an ozone generator for introducing ozone into the air that is pumped into each inflation bladder.

6. The mattress system of claim 5 wherein the ozone generator includes a photo catalytic oxidization device.

7. The mattress system of claim 1 wherein the air treatment apparatus includes an ultraviolet light sanitizer for introducing sanitized air into the air that is pumped into each inflation bladder.

8. The mattress system of claim 1 wherein the air pump further includes an auxiliary output port adapted for pressurizing one of a plurality of auxiliary attachments with the treated air, each auxiliary attachment including an inlet port and a plurality of the deflation pinholes.

9. The mattress system of claim 8 wherein at least one of the auxiliary attachments is a sleeve adapted for securing around an appendage of the patient and directing the treated air inwardly thereto.

10. The mattress system of claim 8 wherein at least one of the auxiliary attachments is a blanket adapted to direct the treated air downwardly about the patient.

11. The mattress system of claim 1 wherein the inflatable mattress is flexible such that when fully deflated the inflatable mattress may be rolled up and stored in a compact configuration.

12. The mattress system of claim 1 wherein the air pump further includes a controller circuit that is adapted to activate or deactivate the air treatment apparatus.

13. The mattress system of claim 2 wherein the air pump further includes a controller circuit that is adapted to inflate any of the inflatable bladders with an electronically-actuated valve mechanism in fluid communication with the output of the air pump, the valve adapted to divert the air flowing from the output of the air pump to a plurality of channel outputs, each channel output in fluid communication with one of the inflatable bladders.

14. A mattress system for a patient, comprising:

an inflatable mattress having at least one inflatable bladder having an inflation port and a plurality of deflation pinholes on a top surface thereof;

an air pump in fluid communication with the inflation port of the at least one inflatable bladder and adapted to pressurize the at least one inflatable bladder with air; and an air treatment apparatus in fluid communication with the air pump and adapted for treating the air pumped into the at least one inflatable bladder;

wherein the inflatable mattress includes a plurality of the inflatable bladders, and wherein the air pump is adapted to inflate each inflatable bladder in turn, such that upon inflation of a first of the inflatable bladders, the air pump switches to inflate a second of the at least one inflatable bladders, the first of the inflatable bladders thereafter deflating as air escapes through the plurality of deflation pinholes therein;

and wherein the air pump further includes a controller circuit that is adapted to inflate any of the inflatable bladders with an electronically-actuated valve mechanism in fluid communication with the output of the air pump, the valve adapted to divert the air flowing from the output of the air pump to a plurality of channel outputs, each channel output in fluid communication with one of the inflatable bladders;

and further including an accessory adapter having a plurality of air inputs, each in fluid communication with one of the channel outputs of the air pump, each of the air inputs in fluid communication with a common output via a check valve, whereby the common output may be fluidly connected to an auxiliary attachment, the auxiliary attachment being inflated regardless of which channel output is supplying air.

15. The mattress system of claim 13 wherein the air pump, air treatment apparatus, controller circuit, and valve mechanism are all contained in a rigid housing, a filter element of the air pump being accessible therethrough at a removable filter cover of the housing.

16. A mattress system for a patient, comprising:

an inflatable mattress having at least one inflatable bladder having an inflation port and a plurality of deflation pinholes on a top surface thereof;

an air pump in fluid communication with the inflation port of the at least one inflatable bladder and adapted to pressurize the at least one inflatable bladder with air; and an air treatment apparatus in fluid communication with the air pump and adapted for treating the air pumped into the at least one inflatable bladder;

wherein the inflatable mattress includes a plurality of the inflatable bladders, and wherein the air pump is adapted to inflate each inflatable bladder in turn, such that upon inflation of a first of the inflatable bladders, the air pump switches to inflate a second of the at least one inflatable bladders, the first of the inflatable bladders thereafter deflating as air escapes through the plurality of deflation pinholes therein;

and wherein the air pump further includes a controller circuit that is adapted to inflate any of the inflatable bladders with an electronically-actuated valve mechanism in fluid communication with the output of the air pump, the valve adapted to divert the air flowing from the output of the air pump to a plurality of channel outputs, each channel output in fluid communication with one of the inflatable bladders;

and wherein the air pump, air treatment apparatus, controller circuit, and valve mechanism are all contained in a rigid housing, a filter element of the air pump being accessible therethrough at a removable filter cover of the housing;

and wherein the controller circuit is adapted to control the speed of the air pump, the duration of the inflation of each of the inflatable bladders by the air pump, the on/off status of the air treatment apparatus, the intensity level of the air treatment apparatus, the type of air treatment provided by the air treatment apparatus, and a schedule for the control of the above.

17. The mattress system of claim 15 wherein the housing further includes an actuator knob for manually selecting and overriding at least one operating parameter of the controller circuit.

* * * * *